US009846397B2

(12) United States Patent
Sawada et al.

(10) Patent No.: US 9,846,397 B2
(45) Date of Patent: Dec. 19, 2017

(54) FIXING DEVICE INCLUDING A SUPPLEMENTARY THERMAL CONDUCTOR AND IMAGE FORMING APPARATUS INCORPORATING SAME

(71) Applicants: Kazunari Sawada, Kanagawa (JP); Kenji Ishii, Kanagawa (JP); Kazuhito Kishi, Kanagawa (JP); Takayuki Seki, Kanagawa (JP); Ippei Fujimoto, Kanagawa (JP); Hiroshi Yoshinaga, Chiba (JP); Takashi Seto, Kanagawa (JP)

(72) Inventors: Kazunari Sawada, Kanagawa (JP); Kenji Ishii, Kanagawa (JP); Kazuhito Kishi, Kanagawa (JP); Takayuki Seki, Kanagawa (JP); Ippei Fujimoto, Kanagawa (JP); Hiroshi Yoshinaga, Chiba (JP); Takashi Seto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/375,757

(22) Filed: Dec. 12, 2016

(65) Prior Publication Data

US 2017/0176907 A1 Jun. 22, 2017

(30) Foreign Application Priority Data

Dec. 17, 2015 (JP) ..... 2015-246089
Nov. 8, 2016 (JP) ..... 2016-217937

(51) Int. Cl.
*G03G 15/20* (2006.01)

(52) U.S. Cl.
CPC ..... *G03G 15/2085* (2013.01)

(58) Field of Classification Search
CPC ..... G03G 15/2017; G03G 15/2028; G03G 15/2053; G03G 15/2085; G03G 2215/2035

(Continued)

(56) References Cited

U.S. PATENT DOCUMENTS 9,026,024 B2 * 5/2015 Ogawa et al. ..... G03G 15/2028 399/329
9,618,887 B2 * 4/2017 Takagi et al. ..... G03G 15/2053

(Continued)

FOREIGN PATENT DOCUMENTS

JP 2010-32631 2/2010
JP 2015-64561 4/2015

OTHER PUBLICATIONS

U.S. Appl. No. 15/178,079, filed Jun. 9, 2016.

*Primary Examiner* — William J Royer
(74) *Attorney, Agent, or Firm* — Oblon, McClelland, Maier & Neustadt, L.L.P.

(57) ABSTRACT

A fixing device includes an endless belt formed into a loop, a heater to heat the endless belt, a nip formation assembly disposed inside the loop, and a pressure rotator to press against the nip formation assembly to form a fixing nip between the endless belt and the pressure rotator. The nip formation assembly includes a pressure pad and a supplementary thermal conductor to conduct heat from the heater in an axial direction of the endless belt. The supplementary thermal conductor has an edge portion dimensioned to distance the supplementary thermal conductor from the endless belt at an end portion of a face over which the endless belt slides in a longitudinal direction of the supplementary thermal conductor. A distance between the edge portion of the supplementary thermal conductor and the (Continued)

endless belt increases toward an end portion of the endless belt in the axial direction thereof.

12 Claims, 9 Drawing Sheets

(58) Field of Classification Search
USPC ..... 399/329
See application file for complete search history.

(56) References Cited

U.S. PATENT DOCUMENTS

| | | | |
|---|---|---|---|
| 2015/0055994 | A1 | 2/2015 | Shoji et al. |
| 2016/0161890 | A1 | 6/2016 | Shoji et al. |
| 2016/0223961 | A1 | 8/2016 | Takagi et al. |
| 2016/0274511 | A1 | 9/2016 | Ogino et al. |
| 2016/0274514 | A1 | 9/2016 | Ishii et al. |
| 2016/0334742 | A1 | 11/2016 | Kobashigawa et al. |

* cited by examiner

FIXING DEVICE INCLUDING A SUPPLEMENTARY THERMAL CONDUCTOR AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2015-246089, filed on Dec. 17, 2015, and 2016-217937, filed on Nov. 8, 2016, in the Japan Patent Office, the entire disclosure of each of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium, incorporating the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

SUMMARY

In one embodiment of the present disclosure, a novel fixing device is described that includes a flexible endless belt formed into a loop and having an inner circumferential surface, a heater to heat the endless belt, and a nip formation assembly disposed inside the loop formed by the endless belt. The nip formation assembly includes a pressure pad and a supplementary thermal conductor to conduct heat from the heater in an axial direction of the endless belt. The supplementary thermal conductor has a belt sliding-contact face over which the inner circumferential surface of the endless belt slides. The fixing device further includes a pressure rotator to press against the nip formation assembly via the endless belt to form a fixing nip between the endless belt and the pressure rotator, through which a recording medium bearing a toner image is conveyed. The supplementary thermal conductor has an edge portion dimensioned to distance the supplementary thermal conductor from the endless belt at an end portion of the belt sliding-contact face in a longitudinal direction of the supplementary thermal conductor parallel to the axial direction of the endless belt. A distance between the edge portion of the supplementary thermal conductor and the endless belt increases toward an end portion of the endless belt in the axial direction of the endless belt.

Also described is a novel image forming apparatus that includes an image forming device to form a toner image and the fixing device described above, disposed downstream from the image forming device in a recording medium conveyance direction, to fix the toner image on a recording medium.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
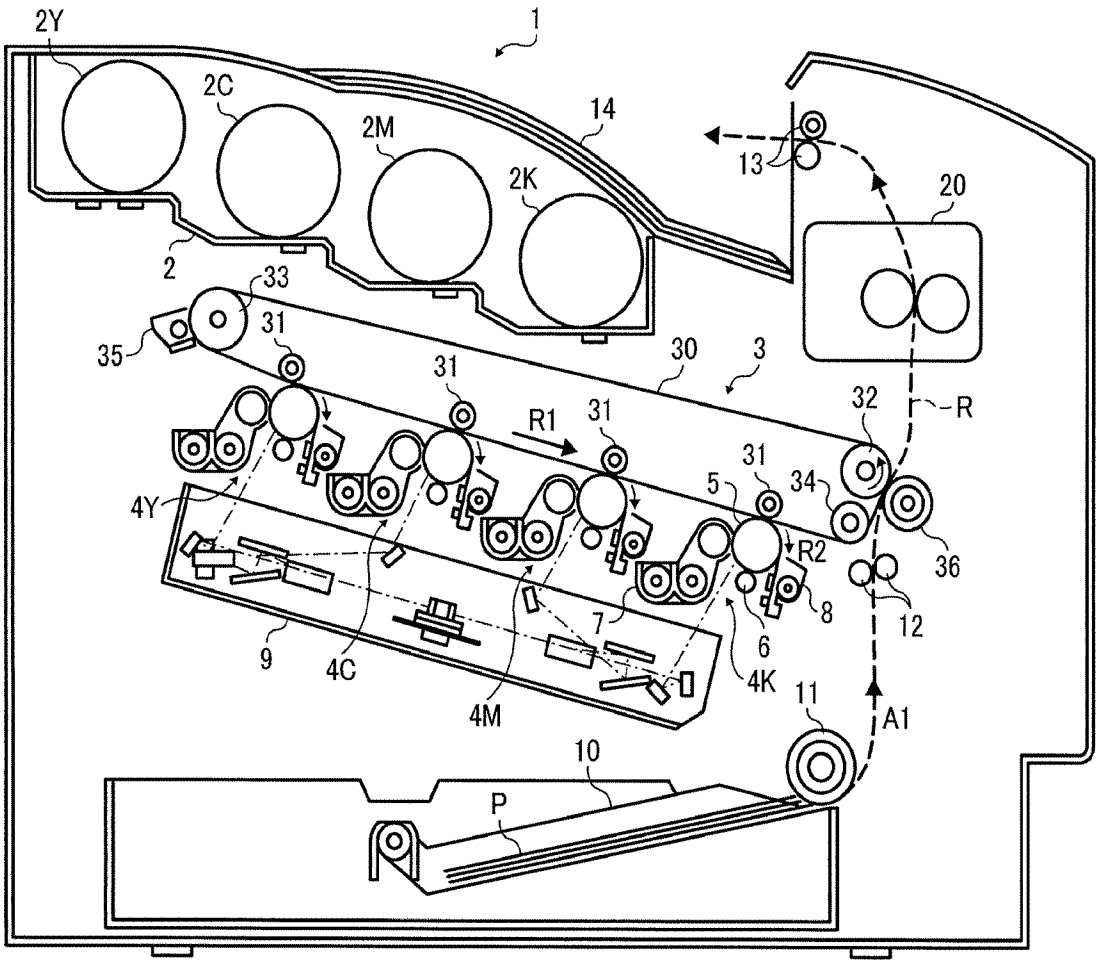
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and K denote colors yellow, cyan, magenta, and black, respectively. To simplify the description, these suffixes are omitted unless necessary.

Referring now to the drawings, embodiments of the present disclosure are described below.

Initially with reference to FIG. 1, a description is given of an overall configuration of an image forming apparatus 1 according to an embodiment of the present disclosure.

FIG. 1 is a schematic view of the image forming apparatus 1.

The image forming apparatus 1 may be a copier, a facsimile machine, a printer, a multifunction peripheral or a multifunction printer (MFP) having at least one of copying, printing, scanning, facsimile, and plotter functions, or the like. In the present embodiment, the image forming apparatus 1 a color laser printer that forms color and monochrome images on recording media by electrophotography. Alternatively, the image forming apparatus 1 may be a monochrome printer that forms a monochrome toner image on a recording medium.

As illustrated in FIG. 1, the image forming apparatus 1 includes, e.g., four image forming devices 4Y, 4C, 4M, and 4K and an intermediate transfer belt 30. The image forming devices 4Y, 4C, 4M, and 4K are situated in the center of a housing of the image forming apparatus 1, and arranged side by side along a direction in which the intermediate transfer belt 30 is stretched. The image forming devices 4Y, 4C, 4M, and 4K have identical configurations while containing different colors of toner as developer. Specifically, the image forming devices 4Y, 4C, 4M, and 4K contain toner of yellow (Y), cyan (C), magenta (M), and black (K), respectively. The colors yellow, cyan, magenta, and black correspond to color separation components of a color image.

Each of the image forming devices 4Y, 4C, 4M, and 4K is an image station that includes, e.g., a drum-shaped photoconductor 5 as a latent image bearer, a charger 6 that charges the surface of the photoconductor 5, a developing device 7 that supplies the surface of the photoconductor 5 with toner, and a cleaner 8 that cleans the surface of the photoconductor 5, as illustrated in the image forming device 4K, for example.

Below the image forming devices 4Y, 4M, 4C, and 4K is an exposure device 9 that exposes the surface of the photoconductor 5. The exposure device 9 includes, e.g., a light source, a polygon mirror, an f-θ lens, and a reflection mirror to irradiate the surface of the photoconductor 5 with a laser beam according to image data.

A transfer device 3 is disposed above the image forming devices 4Y, 4C, 4M, and 4K. The transfer device 3 includes the intermediate transfer belt 30 as a transfer body, four primary transfer rollers 31 as primary transfer devices, a secondary transfer roller 36 as a secondary transfer device, a secondary transfer backup roller 32, a cleaning backup roller 33, a tension roller 34, and a belt cleaner 35.

The intermediate transfer belt 30 is an endless belt entrained around the secondary transfer backup roller 32, the cleaning backup roller 33, and the tension roller 34. In the present embodiment, as a driver drives and rotates the secondary transfer backup roller 32 counterclockwise, the intermediate transfer belt 30 rotates in a counter-clockwise rotational direction R1 as illustrated in FIG. 1 by friction therebetween.

The four primary transfer rollers 31 sandwich the intermediate transfer belt 30 together with the respective photoconductors 5, thereby forming four primary transfer areas herein referred to as primary transfer nips between the intermediate transfer belt 30 and the photoconductors 5. A power supply of the image forming apparatus 1 is connected to the primary transfer rollers 31. The power supply applies predetermined direct current (DC) voltage and/or alternating current (AC) voltage to each of the primary transfer rollers 31.

The secondary transfer roller 36 sandwiches the intermediate transfer belt 30 together with the secondary transfer backup roller 32, thereby forming a secondary transfer area herein referred to as a secondary transfer nip between the secondary transfer roller 36 and the intermediate transfer belt 30. Similar to the primary transfer rollers 31, the power supply of the image forming apparatus 1 is connected to the secondary transfer roller 36. The power supply applies predetermined DC voltage and/or AC voltage to the secondary transfer roller 36.

The belt cleaner 35 includes a cleaning brush and a cleaning blade that contact an outer circumferential surface of the intermediate transfer belt 30.

A bottle holder 2 is disposed in an upper portion of the housing of the image forming apparatus 1. The bottle holder 2 accommodates removable four toner bottles 2Y, 2C, 2M, and 2K that contain fresh toner of yellow, cyan, magenta, and black, respectively. Toner supply tubes are interposed between the toner bottles 2Y, 2C, 2M, and 2K and the respective developing devices 7. The fresh toner is supplied from the toner bottles 2Y, 2C, 2M, and 2K to the respective developing devices 7 through the toner supply tubes.

In a lower portion of the housing of the image forming apparatus 1 are, e.g., a sheet tray 10 and a sheet feeding roller 11. The sheet tray 10 accommodates a plurality of sheets P as recording media. The sheet feeding roller 11 picks up and feeds the plurality of sheets P one at a time from the sheet tray 10 toward the secondary transfer nip formed between the secondary transfer roller 36 and the intermediate transfer belt 30. The sheets P as recording media may be plain paper, thick paper, postcards, envelopes, thin paper, coated paper, art paper, tracing paper, overhead projector (OHP) transparencies, and the like. Optionally, the image forming apparatus 1 may include a bypass feeder that imports such recording media placed on a bypass tray into the image forming apparatus 1.

In the housing of the image forming apparatus 1 is a conveyance passage R defined by internal components of the image forming apparatus 1. Along the conveyance passage R, the sheet P is conveyed from the sheet tray 10 to a sheet ejection roller pair 13 via the secondary transfer nip. The sheet ejection roller pair 13 ejects the sheet P outside the housing of the image forming apparatus 1. Along the conveyance passage R are, e.g., a registration roller pair 12, a fixing device 20, and the sheet ejection roller pair 13. The registration roller pair 12 is disposed upstream from the secondary transfer roller 36 in a sheet conveyance direction A1 as a recording medium conveyance direction. The registration roller pair 12, as a conveyance device, conveys the sheet P to the secondary transfer nip.

The fixing device 20 is disposed downstream from the secondary transfer roller 36 in the sheet conveyance direction A1. The fixing device 20 receives the sheet P bearing a toner image and fixes the toner image on the sheet P. The sheet ejection roller pair 13 is disposed downstream from the fixing device 20 in the sheet conveyance direction A1. The sheet ejection roller pair 13 ejects the sheet P onto an output tray 14. The output tray 14 is disposed atop the housing of the image forming apparatus 1. The plurality of sheets P ejected by the sheet ejection roller pair 13 rests on the output tray 14 one by one.

To provide a fuller understanding of embodiments of the present disclosure, a description is now given of an image forming operation of the image forming apparatus 1 with continued reference to FIG. 1.

When a print job starts, a driver drives and rotates the photoconductor 5 of each of the image forming devices 4Y, 4C, 4M, and 4K in a clockwise rotational direction R2 as illustrated in FIG. 1. The charger 6 uniformly charges the surface of the photoconductor 5 to a predetermined polarity. The exposure device 9 irradiates the surface of the photoconductor 5 thus charged, with a laser beam to form an electrostatic latent image on the surface of the photoconductor 5 according to image data. It is to be noted that the image data is single-color image data obtained by separating a desired full-color image into individual color components, that is, yellow, cyan, magenta, and black components. The developing device 7 supplies toner to the electrostatic latent image thus formed on the surface of the photoconductor 5 to render the electrostatic latent image visible as a toner image.

Meanwhile, when the print job starts, the driver drives and rotates the secondary transfer backup roller 32 counterclockwise in FIG. 1 to rotate the intermediate transfer belt 30 in the rotational direction R1. The power supply applies a constant voltage or constant current control voltage having a polarity opposite a polarity of the toner to each of the primary transfer rollers 31. Accordingly, a transfer electric field is generated at each of the primary transfer nips between the primary transfer rollers 31 and the respective photoconductors 5.

When the toner image formed on the photoconductor 5 reaches the primary transfer nip in accordance with rotation of the photoconductor 5, the transfer electric field thus generated transfers the toner image from the photoconductor 5 onto the intermediate transfer belt 30. Specifically, toner images of yellow, cyan, magenta, and black are superimposed one atop another while being transferred onto the intermediate transfer belt 30. Thus, a full-color toner image is formed on the surface of the intermediate transfer belt 30. The cleaner 8 removes residual toner, failed to be transferred onto the intermediate transfer belt 30 and therefore remaining on the surface of the photoconductor 5, from the photoconductor 5. Then, a discharger discharges the surface of the photoconductor 5 to initialize the surface potential of the photoconductor 5.

In the lower portion of the image forming apparatus 1, the sheet feeding roller 11 starts rotation to feed the sheet P from the sheet tray 10 toward the registration roller pair 12 along the conveyance passage R. The registration roller pair 12 is timed to convey the sheet P to the secondary transfer nip between the secondary transfer roller 36 and the intermediate transfer belt 30 so that the sheet P meets the full-color toner image formed on the surface of the intermediate transfer belt 30 at the secondary transfer nip. The secondary transfer roller 36 is applied with a transfer voltage having a polarity opposite a polarity of the charged toner contained in the full-color toner image formed on the intermediate transfer belt 30, thereby generating a transfer electric field at the secondary transfer nip.

When the full-color toner image formed on the intermediate transfer belt 30 reaches the secondary transfer nip in accordance with rotation of the intermediate transfer belt 30, the transfer electric field thus generated transfers the toner images of yellow, cyan, magenta, and black constructing the full-color toner image from the intermediate transfer belt 30 onto the sheet P collectively. The belt cleaner 35 removes residual toner, failed to be transferred onto the sheet P and therefore remaining on the intermediate transfer belt 30, from the intermediate transfer belt 30. The removed toner is conveyed and collected into the waste toner container disposed in the housing of the image forming apparatus 1.

The sheet P bearing the full-color toner image is conveyed to the fixing device 20 that fixes the full-color toner image onto the sheet P. Then, the sheet P bearing the fixed full-color toner image is conveyed to the sheet ejection roller pair 13 that ejects the sheet P onto the output tray 14 atop the image forming apparatus 1. Thus, the plurality of sheets P rests on the output tray 14.

As described above, the image forming apparatus 1 forms a full-color image on a recording medium. Alternatively, the image forming apparatus 1 may use one of the image forming devices 4Y, 4C, 4M, and 4K to form a monochrome image, or may use two or three of the image forming devices 4Y, 4C, 4M, and 4K to form a bicolor or tricolor image, respectively.

Figure 2:
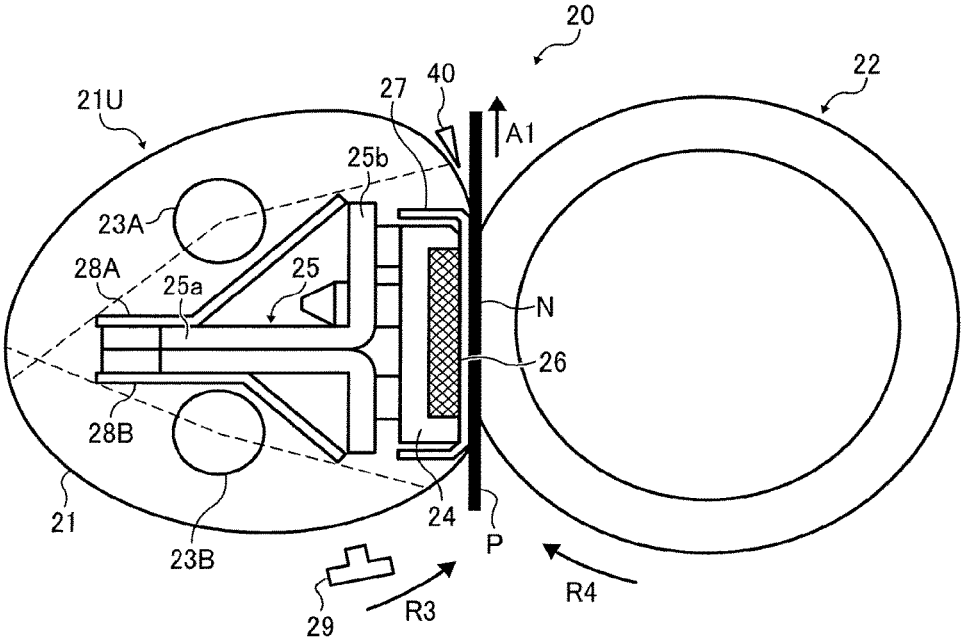
FIG. 2 is a schematic cross-sectional view of a fixing device incorporated in the image forming apparatus of FIG. 1, according to a first embodiment of the present disclosure.
Figure 3:
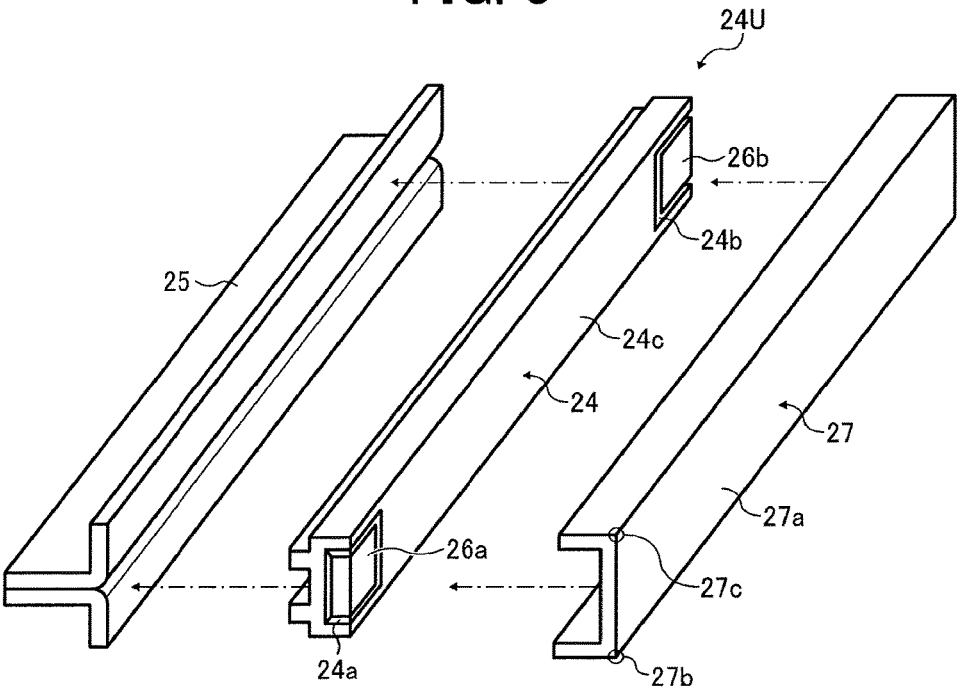
FIG. 3 is an exploded perspective view of a nip formation assembly incorporated in the fixing device of FIG. 2, illustrating relative positions of a nip formation pad, a stay, an end heater, and a supplementary thermal conductor.

Referring now to FIGS. 2 and 3, a description is given of the fixing device 20 incorporated in the image forming apparatus 1 described above.

FIG. 2 is a schematic cross-sectional view of the fixing device 20 according to a first embodiment of the present disclosure. FIG. 3 is an exploded perspective view of a nip formation assembly 24U incorporated in the fixing device 20, illustrating relative positions of a nip formation pad 24, a stay 25, an end heater 26, and a supplementary thermal conductor 27.

The fixing device 20 (e.g., a fuser or a fuser unit) includes a fixing belt 21 formed into a loop, a pressure roller 22, a temperature sensor 29, a separator 40, and various components disposed inside the loop formed by the fixing belt 21 such as a plurality of heaters 23A and 23B, the nip formation pad 24, the stay 25, the end heater 26, the supplementary thermal conductor 27, and a plurality of reflectors 28A and 28B. The fixing belt 21 and the components disposed inside the loop formed by the fixing belt 21 constitute a belt unit 21U detachably coupled to the pressure roller 22. The fixing belt 21 is an endless belt formed as a thin, flexible, tubular fixing rotator rotatable in a counter-clockwise rotational direction R3 as illustrated in FIG. 2. The pressure roller 22 is a pressure rotator that is rotatable in a clockwise rotational direction R4 as illustrated in FIG. 2 and contacts an outer circumferential surface of the fixing belt 21 at an area of contact herein referred to as a fixing nip N. The fixing belt 21 is heated by heat radiating from the heaters 23A and 23B disposed inside the loop formed by the fixing belt 21. In the present embodiment, the heaters 23A and 23B are halogen heaters. Alternatively, the heaters 23A and 23B may be induction heaters, resistance heat generators, carbon heaters, or the like.

The nip formation pad 24 extends in an axial direction, that is, a longitudinal direction, of the fixing belt 21 inside the loop formed by the fixing belt 21. The nip formation pad 24 faces the pressure roller 22 via the fixing belt 21, thereby forming the fixing nip N between the fixing belt 21 and the pressure roller 22. The stay 25 is a support that supports the nip formation pad 24 inside the loop formed by the fixing belt 21. Specifically, the stay 25 secures and supports the nip formation pad 24 against the pressure roller 22. Thus, the stay 25 prevents bending of the nip formation pad 24, thereby maintaining a uniform width of the fixing nip N throughout the length of the pressure roller 22 in an axial direction thereof. The nip formation pad 24 is made of a heat-resistant material having good mechanical strength and heatproof up to about 200° C. or higher. More specifically, the nip formation pad 24 is made of a heat-resistant resin such as polyimide (PI) resin, polyether ether ketone (PEEK) resin, or one of those resins reinforced with glass fibers. Such a material prevents deformation of the nip formation pad 24 due to heat at a toner fixing temperature, thereby securing a stable fixing nip N, keeping output image quality stable. Opposed end portions of the stay 25 in a longitudinal direction thereof parallel to the axial direction of the fixing belt 21 are secured to and thus held by a side plate of the fixing device 20 or a holder mounted on the side plate of the fixing device 20. Similarly, opposed end portions of the heaters 23A and 23B in a longitudinal direction thereof parallel to the axial direction of the fixing belt 21 are secured to and thus held by the side plate of the fixing device 20 or the holder mounted on the side plate of the fixing device 20. The end heater 26, different from main heaters or fixing heaters (i.e., heaters 23A and 23B), includes end heaters 26*a* and 26*b* as illustrated in FIG. 3. The end heaters 26*a* and 26*b* are mounted on opposed end portions of the nip formation pad 24 in a longitudinal direction thereof, parallel to the axial direction of the fixing belt 21, as integral parts of the nip formation pad 24. In the present embodiment, the end heater 26 is a contact, heat-transfer heater such as a ceramic heater.

The supplementary thermal conductor 27 (e.g., thermal equalizer) facilitates heat transfer in the axial direction of the fixing belt 21. Inside the loop formed by the fixing belt 21, the supplementary thermal conductor 27 covers a nip formation face 24*c* of the nip formation pad 24 and the surface of the end heater 26 (i.e., end heaters 26*a* and 26*b*), both of which face an inner circumferential surface of the fixing belt 21. For example, when a relatively small sheet is conveyed or when the end heater 26 is activated, the supplementary thermal conductor 27 prevents heat generated by the end heater 26 from being stored locally at an end portion of the fixing belt 21 and facilitates conduction of the heat in the axial direction of the fixing belt 21, that is, a longitudinal direction of the supplementary thermal conductor 27, thereby equalizing the temperature of the fixing belt 21 in the axial direction thereof. The supplementary thermal conductor 27 is made of a material that conducts heat well, that is, a material having enhanced thermal conductivity. The supplementary thermal conductor 27 has a flattened belt sliding-contact face 27*a* facing and directly contacting the inner circumferential surface of the fixing belt 21, thus serving as a flat nip formation face. Alternatively, the belt sliding-contact face 27*a* of the supplementary thermal conductor 27 may be given a concave shape or another shape. For example, a concave nip formation face directs a leading edge of the sheet P toward the pressure roller 22 as the sheet P is ejected from the fixing nip N, thereby facilitating separation of the sheet P from the fixing belt 21 and preventing a paper jam.

As illustrated in FIG. 2, the temperature sensor 29 is disposed at a predetermined position opposite an outer circumferential surface of the fixing belt 21 to detect the temperature of the fixing belt 21. The separator 40 is disposed downstream from the fixing nip N in the sheet conveyance direction A1 to separate the sheet P from the fixing belt 21. A pressure device is also disposed to press the pressure roller 22 against the fixing belt 21 and to separate the pressure roller 22 from the fixing belt 21.

The fixing belt 21 is an endless belt that is thin as a film and having a decreased diameter to reduce thermal capacity. The fixing belt 21 is constructed of a base layer and a release layer coating the base layer. The base layer of the fixing belt 21 is made of a metal material, such as nickel or stainless steel (e.g., steel use stainless or SUS), or a resin material such as polyimide. The release layer of the fixing belt 21 is made of, e.g., tetrafluoroethylene-perfluoroalkyl vinyl ether copolymer (PFA), or polytetrafluoroethylene (PTFE). Optionally, an elastic layer made of an elastic material such as silicon rubber, silicon rubber foam, or fluoro rubber may be interposed between the base layer and the release layer of the fixing belt 21. As the fixing belt 21 and the pressure roller 22 sandwich and press against the toner image on the sheet P passing through the fixing nip N, slight surface asperities in the fixing belt 21 may be transferred onto the toner image on the sheet P, resulting in variation in gloss of the toner image. To address this circumstance, the elastic layer may be provided with a thickness of about 100 μm. As the elastic layer deforms, the elastic layer absorbs the slight surface asperities in the fixing belt 21, thereby preventing such variation in gloss of the toner image. The fixing belt 21 has an overall thickness not larger than about 1 mm and a diameter of from about 20 mm to about 40 mm to reduce thermal capacity. The base layer of the fixing belt 21 has a thickness of from about 20 μm to about 50 μm. The elastic layer of the fixing belt 21 has a thickness of from about 100 μm to about 300 μm. The release layer of the fixing belt 21 has a thickness of from about 10 μm to about 50 μm. To further reduce thermal capacity, preferably, the fixing belt 21 may have an overall thickness not larger than about 0.2 mm, and more preferably, not larger than about 0.16 mm while having a diameter not larger than about 30 mm.

The stay 25, having a T-shaped cross section, includes a projection 25*a* and a base 25*b*. The projection 25*a* projects from the base 25*b* away from the fixing nip N in a direction perpendicular to the longitudinal direction of the stay 25. The projection 25*a* separates the heaters 23A and 23B as main heaters from each other. One of the heaters 23A and 23B has a heat generation range at a center portion of the longitudinal direction thereof to heat the fixing belt 21 and fix a toner image on a relatively small sheet P. The other one of the heaters 23A and 23B has a heat generation range at each end portion in the longitudinal direction thereof to heat the fixing belt 21 and fix a toner image on a relatively large sheet P. The heaters 23A and 23B generates heat under output control of the power supply disposed in the housing of the image forming apparatus 1, based on a surface temperature of the fixing belt 21 detected by the temperature sensor 29, thereby setting the temperature of the fixing belt 21 to a desired fixing temperature.

The reflectors 28A and 28B are interposed between the stay 25 and the heaters 23A and 23B, respectively, to reflect light radiated from the heaters 23A and 23B toward the fixing belt 21, thereby enhancing heating efficiency of the heaters 23A and 23B to heat the fixing belt 21. The reflectors 28A and 28B prevent light and heat radiated from the heaters 23A and 23B from heating the stay 25, suppressing waste of energy. Alternatively, instead of the reflectors 28A and 28B, the surface of the stay 25 facing the heaters 23A and 23B may be insulated or given a mirror finish to reflect light or heat radiating from the heaters 23A and 23B toward the fixing belt 21.

Figure 6:
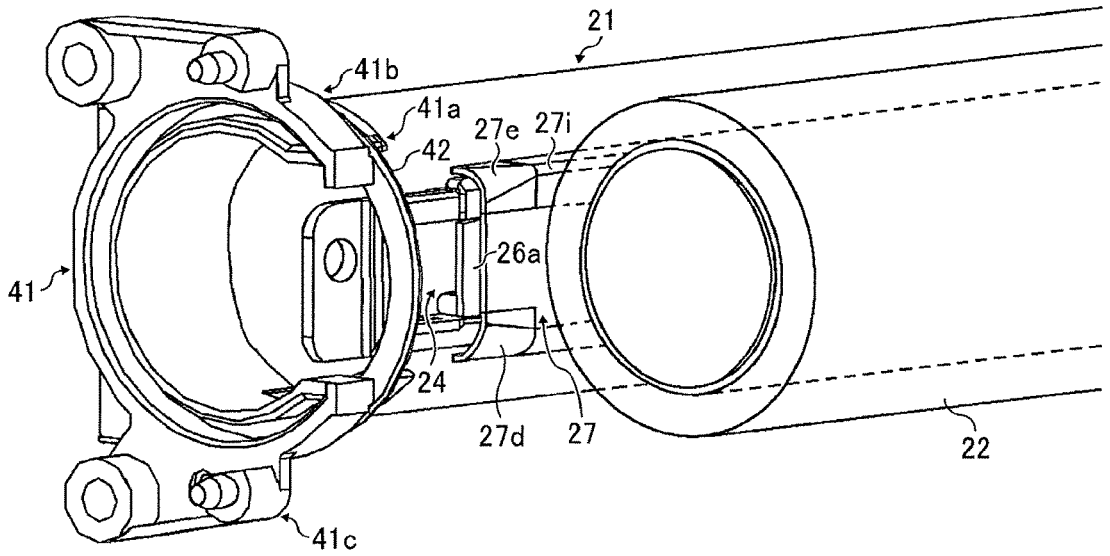
FIG. 6 is a schematic view of a fixing belt and associated components, particularly illustrating a configuration to regulate rotation of the fixing belt.

The pressure roller 22 is constructed of a tube (e.g., metal tube), an elastic layer coating the tube, and a release layer coating the elastic layer. The elastic layer is made of rubber such as silicone rubber form or fluororubber. The release layer is made of PFA or PTFE to facilitate separation of the sheet P from the pressure roller 22. As a biasing mechanism (e.g., spring) presses the pressure roller 22 against the fixing belt 21, the elastic layer of the pressure roller 22 is deformed, forming an area of contact (e.g., fixing nip N) having a predetermined width between the fixing belt 21 and the pressure roller 22. A driver such as a motor situated inside the housing of the image forming apparatus 1 drives and rotates the pressure roller 22 in the rotational direction R4. As the driver generates a driving force and rotates the pressure roller 22, the driving force is transmitted from the pressure roller 22 to the fixing belt 21 at the fixing nip N, thereby rotating the fixing belt 21 in the rotational direction R3. At the fixing nip N, the fixing belt 21 rotates while being sandwiched between the pressure roller 22 and the nip formation pad 24 having the nip formation face 24*c* covered by the supplementary thermal conductor 27. On the other hand, at a circumferential span of the fixing belt 21 other than the fixing nip N, the fixing belt 21 rotates while being guided by a flange 41 situated at each end portion of the fixing belt 21 in the axial direction thereof as illustrated in FIG. 6.

In the present embodiment, the pressure roller 22 is a solid roller. Alternatively, the pressure roller 22 may be a hollow roller, i.e., a tube. If the pressure roller 22 is a hollow roller, optionally a heater such as a halogen heater may be disposed inside the pressure roller 22. The elastic layer may be made of solid rubber. Alternatively, if no heater is situated inside the pressure roller 22, the elastic layer may be made of sponge rubber. The sponge rubber is preferable to solid rubber because the sponge rubber has enhanced insulation that draws less heat from the fixing belt 21.

As illustrated in FIG. 3, the nip formation assembly 24U includes the nip formation pad 24, the stay 25, the supplementary thermal conductor 27, and the end heater 26. The nip formation pad 24 has a surface facing away from the fixing nip N and engaging a flat surface of the stay 25 facing the fixing nip N. For example, the engaged surfaces of the nip formation pad 24 and the stay 25 may have convex and concave portions such as a pin and a boss, respectively, to be coupled to each other. The supplementary thermal conductor 27 is fitted on the nip formation pad 24 given an approximately rectangular shape, covering a surface of the nip formation pad 24 facing the inner circumferential surface of the fixing belt 21. In the present embodiment, the supplementary thermal conductor 27 engages the nip formation pad 24 with, e.g., a projection. Alternatively, the supplementary thermal conductor 27 may be attached to the nip formation pad 24 with, e.g., an adhesive. Two recesses 24*a* and 24*b* that define a difference in thickness of the nip formation pad 24 are disposed at the opposed end portions of the nip formation pad 24 in the longitudinal direction thereof. The end heaters 26*a* and 26*b* that constitute the end heater 26 illustrated in FIG. 2 are secured to the recesses 24*a* and 24*b*, respectively. Thus, the recesses 24*a* and 24*b* accommodate the end heaters 26*a* and 26*b*, respectively.

Although the belt sliding-contact face 27*a* of the supplementary thermal conductor 27 faces the inner circumferential surface of the fixing belt 21, the nip formation face 24*c* of the nip formation pad 24 facing the pressure roller 22 actually forms the fixing nip N in view of the mechanical strength that the nip formation face 24*c* of the nip formation pad 24 provides.

Typically, in fixing devices including an endless fixing belt formed into a loop and having a relatively low thermal capacity, the fixing belt is rotated by rotation of a pressure roller disposed opposite the fixing belt. While rotating, the fixing belt slides over a high-thermal conductor attached to a nip formation pad secured in the loop formed by the fixing belt. To reduce friction resistance between the fixing belt and the thermal conductor, a low-friction sheet is generally disposed on a belt-sliding face of the thermal conductor over which the fixing belt slides. However, heating the low-friction sheet typically having a thickness of several hundred micrometers uses extra energy, and may hamper effective energy consumption of the fixing device. Therefore, such a low-friction sheet may be excluded from the fixing device. In the fixing devices without the low-friction sheet, the fixing belt directly contacts and slides over the thermal conductor. Since the thermal conductor is typically made of metal such as copper or aluminum having a relatively high heat conductivity, the fixing belt receives a relatively high load while sliding over the thermal conductor. Specifically, an inner circumferential surface of the fixing belt contacts corners and edges at opposed end portions of the thermal conductor in a longitudinal direction thereof and receives a relatively high load from the corners and edges of the thermal conductor. As a result, the fixing belt may be scraped, have a kink or plastic recess, or the like, thus being damaged. Such damage to the fixing belt prematurely shortens the working life of the fixing belt.

Figure 4:
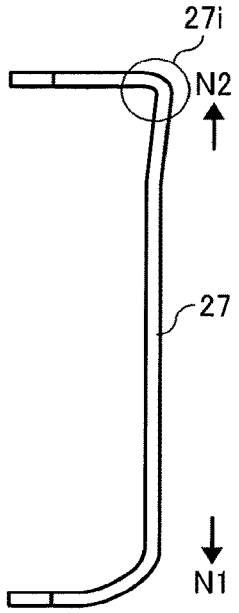
FIG. 4 is a cross-sectional view of the supplementary thermal conductor.

FIG. 4 is a cross-sectional view of the supplementary thermal conductor 27. Typically, the supplementary thermal conductor 27 has an angular, U-shaped cross section. If no treatment is given, the supplementary thermal conductor 27 may have angular corners 27*b* and 27*c* as illustrated in FIG. 2 at each end portion in the longitudinal direction thereof. In other words, the supplementary thermal conductor 27 may have angular corners 27*b* and 27*c* on an entry side N1 of the fixing nip N, located upstream in the sheet conveyance direction A1, and on an exit side N2 of the fixing nip N, located downstream in the sheet conveyance direction A1, respectively. Particularly, to facilitate separation of the sheet P from the fixing belt 21, the supplementary thermal conductor 27 is inclined toward the fixing belt 21, forming a convex portion 27*i* on the exit side N2 of the fixing nip N. On the exit side N2 of the fixing nip N, the angular corner 27*c* may have strong contact with and overload the inner circumferential surface of the fixing belt 21 on the exit side N2 of the fixing nip N, damaging the inner circumferential surface of the fixing belt 21 by, e.g., scraping or producing a kink. Similarly, on the entry side N1 of the fixing nip N, the angular corner 27*b* may have strong contact with the inner circumferential surface of the fixing belt 21 when the fixing belt 21 enters the fixing nip N, damaging the inner circumferential surface of the fixing belt 21 by, e.g., scraping or producing a kink.

Hence, in the present embodiment, the angular corners 27*b* and 27*c* of the belt sliding-contact face 27*a*, which are located on the entry side N1 and the exit side N2 of the fixing nip N, respectively, at each end portion of the supplementary thermal conductor 27, are recessed, forming non-contact areas corresponding the angular corners 27*b* and 27*c* between the supplementary thermal conductor 27 and the fixing belt 21, where the supplementary thermal conductor 27 does not contact the fixing belt 21.

Figure 5:
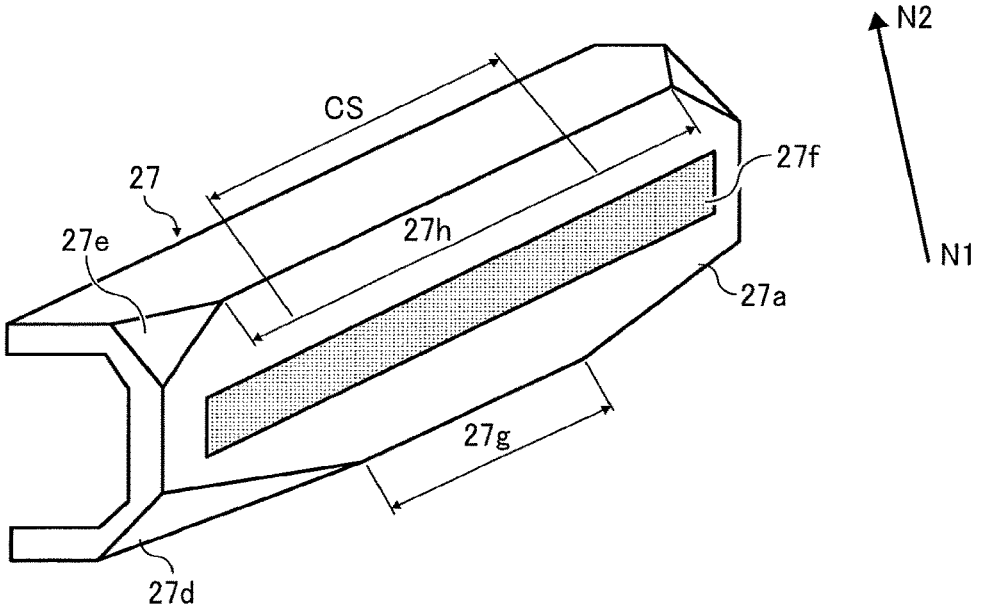
FIG. 5 is a perspective view of a first example of the supplementary thermal conductor having flank faces.

Referring now to FIG. 5, a description is given of a first example of the supplementary thermal conductor 27 having flank faces.

FIG. 5 is a perspective view of the first example of the supplementary thermal conductor 27 having flank faces 27*d* and 27*e* on the entry side N1 and the exit side N2 of the fixing nip N, respectively.

The fixing belt 21 has a larger distance from the flank faces 27*d* and 27*e* outwards in the axial direction of the fixing belt 21. As illustrated in FIG. 5, the supplementary thermal conductor 27 has the flat, triangular flank faces 27*d* and 27*e* made by removing the angular corners 27*b* and 27*c*, respectively. The flank faces 27*d* and 27*e* serve as edge portions dimensioned to distance the supplementary thermal conductor 27 from the fixing belt 21. When the fixing belt 21 slides over the belt sliding-contact face 27*a* of the supplementary thermal conductor 27, the flank faces 27*d* and 27*e* reduce load on the inner circumferential surface of the fixing belt 21, thereby preventing the inner circumferential surface of the fixing belt 21 from being damaged by being scraped, having a kink, or the like. The flank faces 27*d* and 27*e* are separated from each other in the sheet conveyance direction A1 to secure functions of the end heaters 26*a* and 26*b* as contact, heat-transfer heaters. Specifically, the end heaters 26*a* and 26*b* are located between the flank faces 27*d* and 27*e*, within an area corresponding to the belt sliding-contact face 27*a* of the supplementary thermal conductor 27.

Referring now to FIG. 6, a description is given of a configuration to regulate rotation of the fixing belt.

FIG. 6 is a schematic view of the fixing belt 21 and associated components, particularly illustrating the configuration to regulate rotation of the fixing belt 21.

As described above, at the fixing nip N, the fixing belt 21 rotates while being sandwiched between the pressure roller 22 and the nip formation pad 24 having the nip formation face 24*c* covered by the supplementary thermal conductor 27. On the other hand, at a circumferential span of the fixing belt 21 other than the fixing nip N, the fixing belt 21 rotates while being guided by the flange 41 situated at each end portion of the fixing belt 21 in the axial direction thereof. That is, the flange 41 regulates a rotational trajectory of the fixing belt 21 at each end portion of the fixing belt 21 in the axial direction thereof. On the other hand, at a center portion of the fixing belt 21 in the axial direction thereof, the fixing belt 21 is not regulated and pressed at the fixing nip N. As illustrated in FIG. 6, the flange 41 as a belt holder is inserted into each end portion of the fixing belt 21 in the axial direction thereof to hold each end portion of the fixing belt 21 in the axial direction thereof rotatably. The flange 41 includes an inserted portion 41*a*, a regulation portion 41*b*, and a secured portion 41*c*. Specifically, the inserted portion 41*a* is inserted into each end portion of the fixing belt 21 in the axial direction thereof The regulation portion 41*b* has a larger outer diameter than an outer diameter of the inserted portion 41*a*. The secured portion 41*c* is secured to a housing of the fixing device 20. The regulation portion 41*b* has a larger outer diameter than at least an outer diameter of the fixing belt 21 to regulate deviation of the fixing belt 21 in the axial direction thereof. The flange 41 as a belt holder has a C-shaped cross section opening on the fixing nip side. In addition, the flange 41 holds an end portion of the stay 25, thus secures the stay 25 at a predetermined position.

A slip ring 42 is interposed between an end face of the fixing belt 21 and the regulation portion 41*b* of the flange 41 disposed opposite the end face of the fixing belt 21, serving as a ring protector to protect the end face of the fixing belt 21.

Accordingly, the fixing belt 21 has different trajectories in the axial direction thereof during rotation.

Figure 7A:
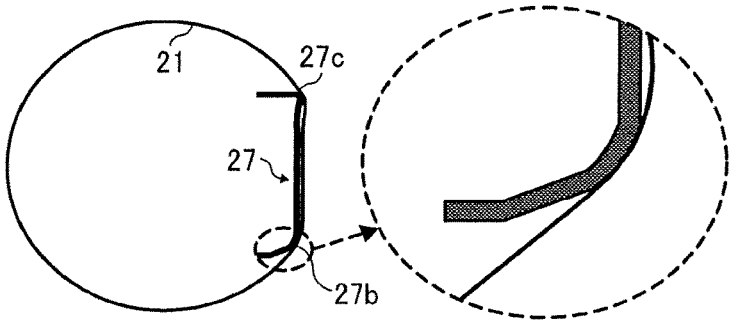
FIG. 7A is a schematic view of a fixing belt and the supplementary thermal conductor having angular corners, illustrating relative positions thereof at an end position.
Figure 7B:
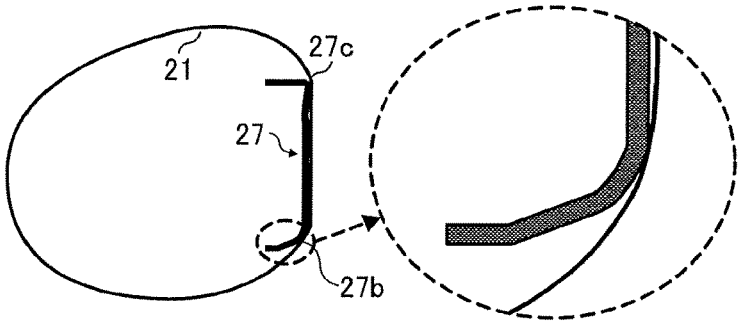
FIG. 7B is a schematic view of the fixing belt and the supplementary thermal conductor having angular corners, illustrating relative positions thereof at a center position.
Figure 8:
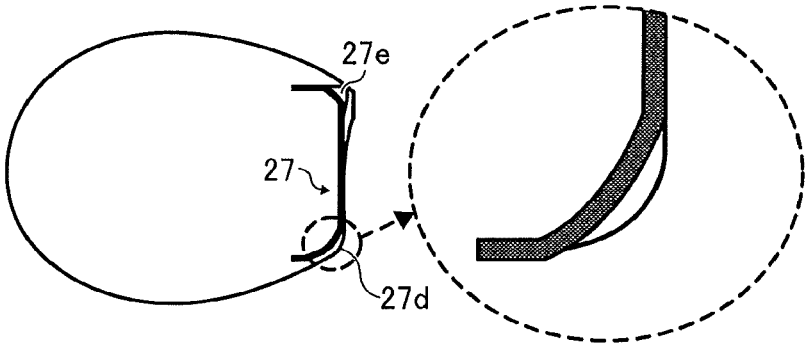
FIG. 8 is a schematic view of the fixing belt and the supplementary thermal conductor having flank faces, illustrating relative positions thereof.

Referring now to FIGS. 7A through 8, a description is given of the different trajectories of the fixing belt 21.

FIG. 7A is a schematic view of the fixing belt 21 and the supplementary thermal conductor 27 having the angular corners 27*b* and 27*c*, illustrating relative positions thereof at an end position. FIG. 7B is a schematic view of the fixing belt 21 and the supplementary thermal conductor 27 having the angular corners 27*b* and 27*c*, illustrating relative positions thereof at a center position. FIG. 8 is a schematic view of the fixing belt 21 and the supplementary thermal conductor 27 having the flank faces 27*d* and 27*e*, illustrating relative positions thereof.

The fixing belt 21 rotates in a substantially round shape at the end position as the flange 41 regulates the end portion of the fixing belt 21 in the axial direction thereof. However, as the regulation exerted by the flange 41 has a decreased influence on the fixing belt 21 toward the center portion of the fixing belt 21 in the axial direction thereof, the fixing belt 21 is substantially free from the influence from the regulation exerted by the flange 41. Therefore, compared to the center portion of the fixing belt 21, each end portion of the fixing belt 21 in the axial direction thereof receives a stronger contact pressure from the supplementary thermal conductor 27 on both the entry side N1 and the exit side N2 of the fixing nip N. In particular, on the entry side N1 of the fixing nip N, the fixing belt 21 comes into strong contact with the supplementary thermal conductor 27 as the fixing belt 21 enters the fixing nip N. Hence, as illustrated in FIG. 8, the supplementary thermal conductor 27 according to the present embodiment removes the angular corners 27*b* and 27*c* therefrom to form the flank faces 27*d* and 27*e* having sufficient surface area not to contact each end portion of the fixing belt 21 that is influenced by the regulation exerted by the flange 41. Preferably, a starting point or inner point of each of the flank faces 27*d* and 27*e* in the longitudinal direction of the supplementary thermal conductor 27 may be distanced away from the flange 41 toward a center portion of the supplementary thermal conductor 27 to decrease a contact pressure from the supplementary thermal conductor 27 to the fixing belt 21 on both the entry side N1 and the exit side N2 of the fixing nip N, so as not to damage the inner circumferential surface of the fixing belt 21 by, e.g., scraping or producing a kink. In other words, the flank faces 27*d* and 27*e* preferably conform to the shape of the fixing belt 21 between the end portion of the fixing belt 21 regulated by the flange 41 to the center portion of the fixing belt 21 corresponding to the fixing nip N, in the axial direction of the fixing belt 21.

The surface areas of the flank faces 27*d* and 27*e* may be equal to or different from each other, provided that the flank faces 27*d* and 27*e* reduce load on the inner circumferential surface of the fixing belt 21. Similarly, the starting points or inner points of the flank faces 27*d* and 27*e* in the longitudinal direction of the supplementary thermal conductor 27 may be equal to or different from each other, provided that the flank faces 27*d* and 27*e* reduce load on the inner circumferential surface of the fixing belt 21.

Referring back to FIG. 5, the flank faces 27*d* and 27*e* do not enter a fixing nip span 27*f*, which is subjected to a given pressure or a higher pressure from the pressure roller 22 via the fixing belt 21. A flank face existing in the fixing nip span 27*f* might inflect a planar surface of the fixing nip span 27*f* and deform the fixing belt 21 and the pressure roller 22 locally, resulting in damage to the fixing belt 21 and the pressure roller 22. Hence, in the present embodiment, the flank faces 27*d* and 27*e* do not enter the fixing nip span 27*f*, maintaining the planar face of the fixing nip span 27*f* and preventing damage to the fixing belt 21 and the pressure roller 22. An entry-side span 27*g* is a span of the belt sliding-contact face 27*a* in the longitudinal direction of the supplementary thermal conductor 27 on the entry side N1 of the fixing nip N. The entry-side span 27*g* can be shorten provided that the flank face 27*d* is not present in the fixing nip span 27*f*. That is, on the entry side N1 of the fixing nip N, which is an upstream side of the fixing nip N in the sheet conveyance direction A1, the flank face 27*d* may start inside an end point of the fixing nip N in a longitudinal direction thereof parallel to the axial direction of the fixing belt 21, in the longitudinal direction of the supplementary thermal conductor 27.

By contrast, as described above and illustrated in FIG. 4, the supplementary thermal conductor 27 is inclined or projecting toward the fixing belt 21 on the exit side N2 of the fixing nip N to bend the fixing belt 21 so as to facilitate separation of the sheet P from the fixing belt 21. An exit-side span 27*h* is a span of the belt sliding-contact face 27*a* in the longitudinal direction of the supplementary thermal conductor 27 on the exit side N2 of the fixing nip N. As an increased inclined angle of the belt sliding-contact face 27*a* facilitates separation of the sheet P from the fixing belt 21, the exit-side span 27*h* is larger than a sheet conveyance span CS as a recording medium conveyance span in the longitudinal direction of the supplementary thermal conductor 27. The sheet conveyance span CS corresponds to a width of a sheet P having a maximum conveyable sheet size in the axial direction of the fixing belt 21. In addition, as described above, the flank face 27*e* is not present in the fixing nip span 27*f*. Thus, on the exit side N2 of the fixing nip N, which is a downstream side of the fixing nip N in the sheet conveyance direction A1, the flank face 27*e* is outside an end point of the sheet conveyance span CS in the longitudinal direction of the supplementary thermal conductor 27.

Provided that the above-described requirements are satisfied on the entry side N1 and the exit side N2 of the fixing nip N, the starting points of the flank faces 27*d* and 27*e* can be determined in the longitudinal direction of the supplementary thermal conductor 27.

Figure 9:
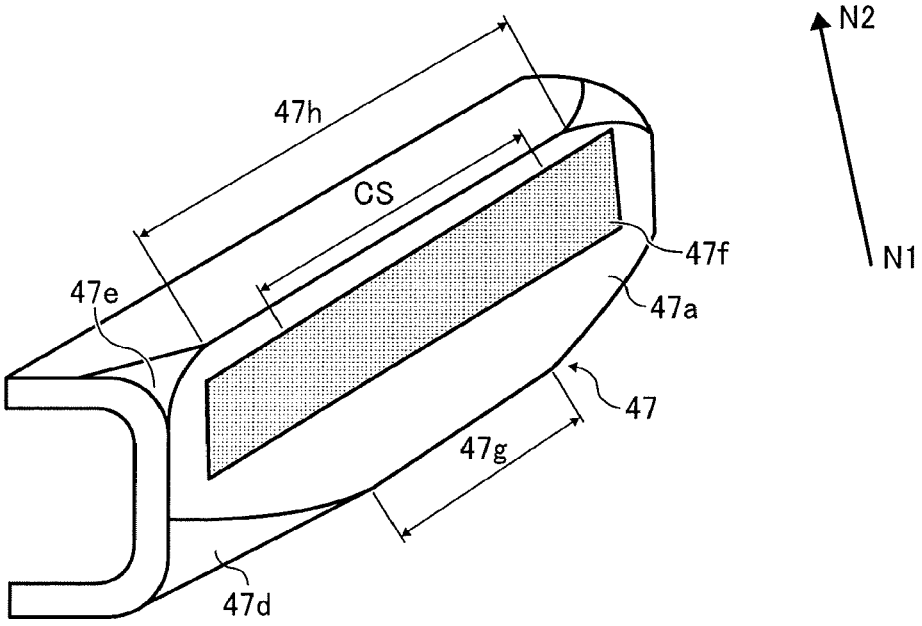
FIG. 9 is a perspective view of a second example of the supplementary thermal conductor having flank faces.

Referring now to FIG. 9, a description is given of a second example of the supplementary thermal conductor 27 having flank faces.

FIG. 9 is a perspective view of a supplementary thermal conductor 47 as the second example of the supplementary thermal conductor 27 having flank faces.

The supplementary thermal conductor 47 has a basic configuration identical to the configuration of the supplementary thermal conductor 27 of FIG. 5. For example, the supplementary thermal conductor 47 has a flattened belt sliding-contact face 47*a* facing the inner circumferential surface of the fixing belt 21. The belt sliding-contact face 47*a* includes a fixing nip span 47*f* subjected to pressure from the pressure roller 22 via the fixing belt 21. An entry-side span 47*g* is a span of the belt sliding-contact face 47*a* in a longitudinal direction of the supplementary thermal conductor 47 on the entry side N1 of the fixing nip N. An exit-side span 47*h* is a span of the belt sliding-contact face 47*a* in the longitudinal direction of the supplementary thermal conductor 47 on the exit side N2 of the fixing nip N.

Instead of the flank faces 27*d* and 27*e* of FIG. 5, however, the supplementary thermal conductor 47 has curved flank faces 47*d* and 47*e* as edge portions dimensioned to distance the supplementary thermal conductor 47 from the fixing belt 21. The trajectory of the fixing belt 21 on the entry side N1 and the exit side N2 of the fixing nip N is a curved shape while the fixing belt 21 rotates. Therefore, the curved flank faces 47*d* and 47*e* further reduces load on the fixing belt 21 compared to the flat flank faces 27*d* and 27*e*.

Figure 10:
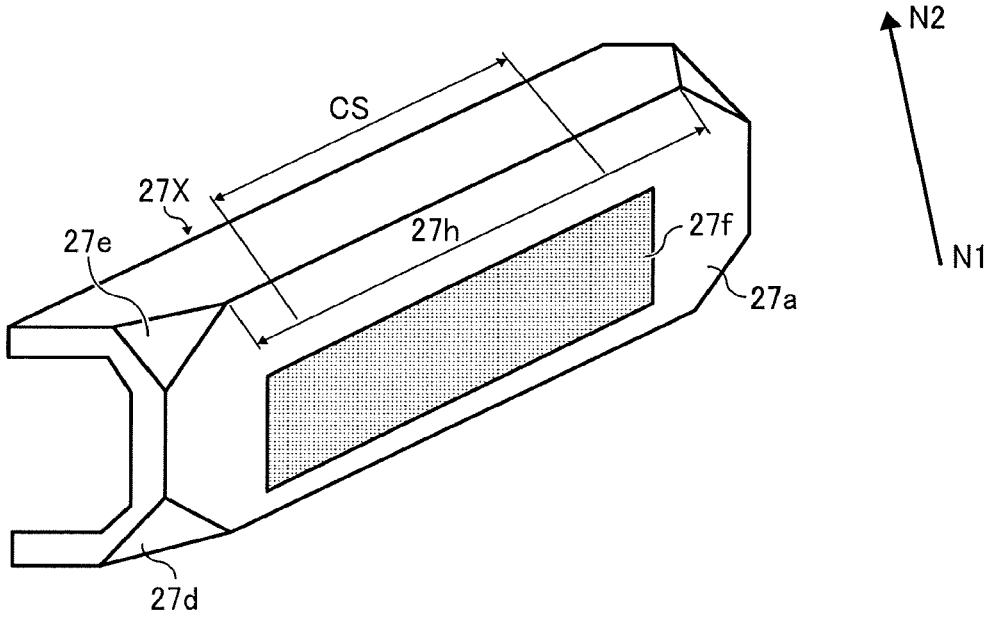
FIG. 10 is a perspective view of a variation of the supplementary thermal conductor of FIG. 5.
Figure 11:
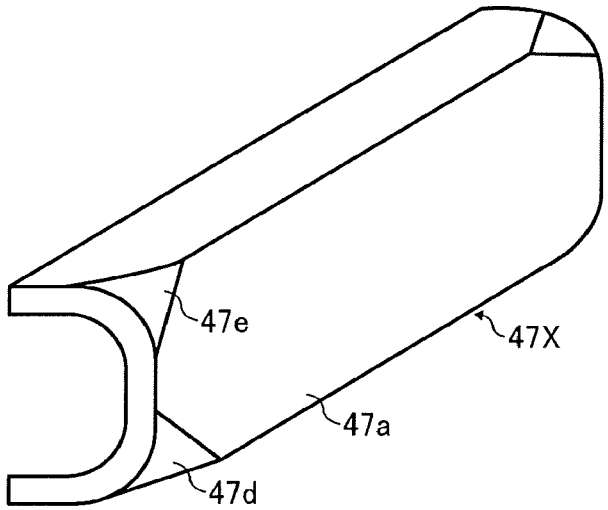
FIG. 11 is a perspective view of a variation of the supplementary thermal conductor of FIG. 9.
Figure 12:
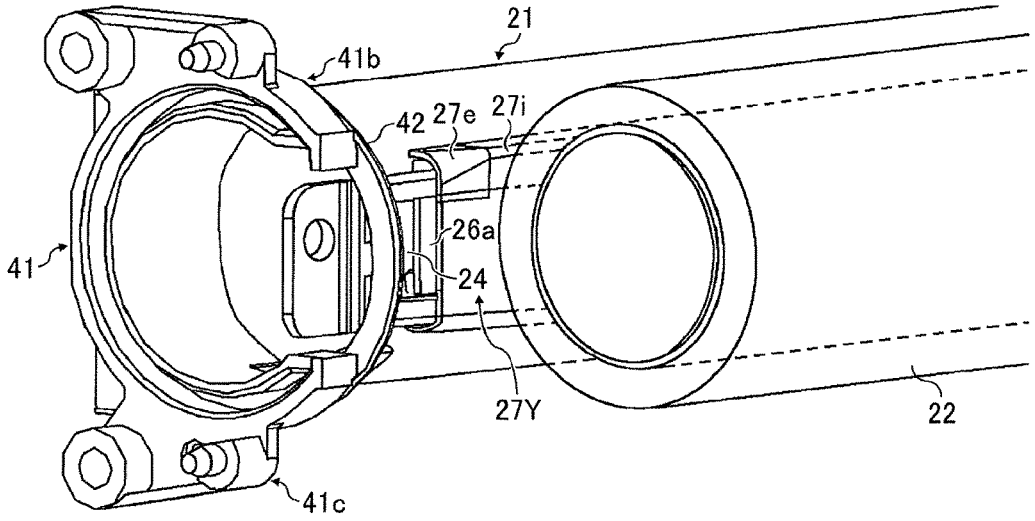
FIG. 12 is a schematic view of the fixing belt and associated components, particularly illustrating another variation of the supplementary thermal conductor of FIG. 5.

Referring now to FIGS. 10 through 12, a description is given of variation of the first and second examples of the supplementary thermal conductor 27 described above.

FIG. 10 is a perspective view of a supplementary thermal conductor 27X as a variation of the supplementary thermal conductor 27 of FIG. 5. FIG. 11 is a perspective view of a supplementary thermal conductor 47X as a variation of the supplementary thermal conductor 47 of FIG. 9. FIG. 12 is a schematic view of the fixing belt 21 and associated components, particularly illustrating a supplementary thermal conductor 27Y as another variation of the supplementary thermal conductor 27 of FIG. 5.

In FIG. 10, the flank face 27*d* is outside the end point of the fixing nip N in the longitudinal direction thereof, in the longitudinal direction of the supplementary thermal conductor 27, on the entry side N1 of the fixing nip N, which is the upstream side of the fixing nip N in the sheet conveyance direction A1. In addition, FIG. 10 illustrates the flank faces 27*d* and 27*e* having substantially identical starting points in a longitudinal direction of the supplementary thermal conductor 27X. Similarly, FIG. 11 illustrates the flank faces 47*d* and 47*e* having substantially identical starting points in a longitudinal direction of the supplementary thermal conductor 47X. In the configurations described above, the supplementary thermal conductor 27 has flank faces on both the entry side N1 and exit side N2 of the fixing nip N. Alternatively, the supplementary thermal conductor 27 may have a flank face on either one of the entry side N1 and the exit side N2 of the fixing nip N. FIG. 12 illustrates the supplementary thermal conductor 27Y having the flank face 27*e* on the exit side N2 of the fixing nip N only.

In the embodiment described above, the supplementary thermal conductor (e.g., supplementary thermal conductors 27 and 47) is an elongated, relatively thin board having a U shape to cover the nip formation pad 24, thus being secured at a predetermined position. A drawing process is executed to press down angular corners of the board, thereby forming the board into the U shape. Thus, the supplementary thermal conductors 27 and 47 are shaped as in, e.g., FIGS. 5 and 9, respectively. The supplementary thermal conductor made of a metal material having enhanced thermal conductivity such as copper or aluminum facilitates a bending process including the drawing process. As the fixing belt 21 slides over a sliding contact surface (e.g., belt sliding-contact faces 27*a* and 47*a*) of the supplementary thermal conductor, abrasion powder may be generated on the sliding contact surface and may damage the supplementary thermal conductor and the inner circumferential surface of the fixing belt 21. To prevent such damage, the supplementary thermal conductor may be preferably made of stainless steel having enhanced abrasion resistance.

The supplementary thermal conductors 27 and 47 and the variations thereof are fitted on the nip formation pad 24 so as to cover the nip formation face 24*c* of the nip formation pad 24, thereby forming a U-shaped cross section. Alternatively, the supplementary thermal conductor may form a cross section of another shape if the supplementary thermal conductor is attached to the nip formation pad 24 or if the supplementary thermal conductor serves as a nip formation pad. In short, the supplementary thermal conductor may be an elongated, relatively thick cubic board having opposed end angular corners in the longitudinal direction thereof removed.

Figure 13A:
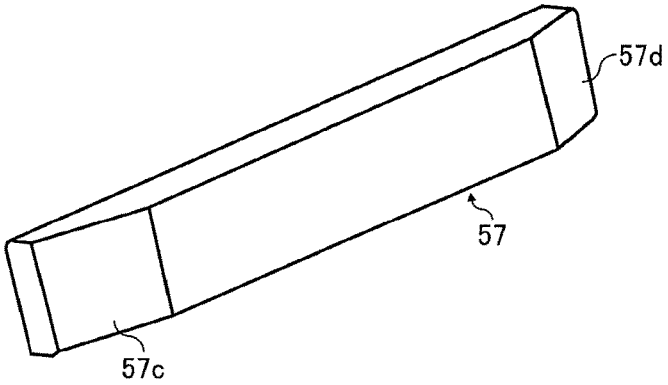
FIG. 13A is a perspective view of a third example of the supplementary thermal conductor having flank faces.
Figure 13B:
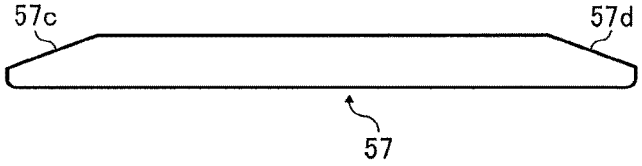
FIG. 13B is a side view of the supplementary thermal conductor of FIG. 13A.

Referring now to FIGS. 13A through 15, a description is given of examples of the supplementary thermal conductor made of an elongated, relatively thick cubic board. FIG. 13A is a perspective view of a supplementary thermal conductor 57 as a third example of the supplementary thermal conductor 27 having flank faces. FIG. 13B is a side view of the supplementary thermal conductor 57. The supplementary thermal conductor 57 is an elongated, relatively thick cubic board having angular corners and edge portions at opposed end portions in a longitudinal direction thereof removed in, e.g., a cutting process. Thus, the supplementary thermal conductor 57 has flank faces 57*c* and 57*d*.

In the drawing process executed on the supplementary thermal conductor (e.g., supplementary thermal conductors 27 and 47) to press down angular corners, metal is bent into a desired shape. Therefore, a drastic change in shape of the supplementary thermal conductor may involve processing of adjacent components. On the other hand, the cutting process determines a component shape by removal of a part of the component. Although the component needs a certain thickness, the cutting process allows an accurate drastic change in shape of the component. Accordingly, cutting not only the corners but also the edge portions of a cubic board forms the flank faces 57*c* and 57*d* of the supplementary thermal conductor 57. Without angular corners and edges in contact with the inner circumferential surface of the fixing belt 21, the supplementary thermal conductor 57 reduces load on the inner circumferential surface of the fixing belt 21.

Figure 14:
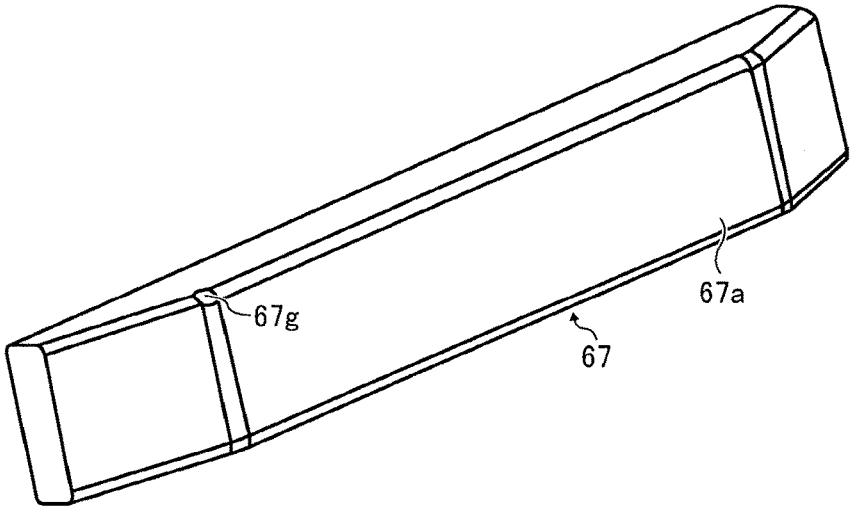
FIG. 14 is a perspective view of a variation of the supplementary thermal conductor of FIGS. 13A and 13B.

The cutting process also allows refined processing. FIG. 14 is a perspective view of a supplementary thermal conductor 67 as a variation of the supplementary thermal conductor 57. In a refined cutting process, each edge and apex of a belt sliding-contact face 67*a* is formed into an arc, curved face 67*g*. Without angular corners and edges in contact with the inner circumferential surface of the fixing belt 21, the supplementary thermal conductor 67 reduces load on the inner circumferential surface of the fixing belt 21.

Figure 15A:
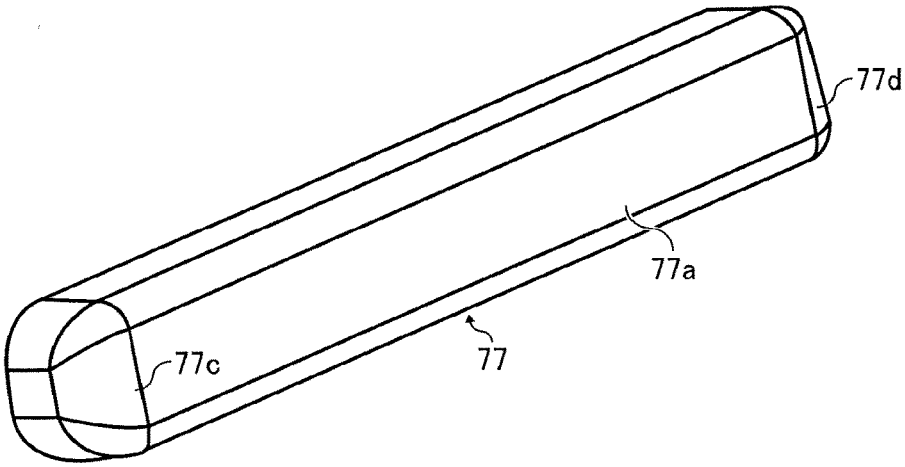
FIG. 15A is a perspective view of a fourth example of the supplementary thermal conductor having flank faces.
Figure 15B:
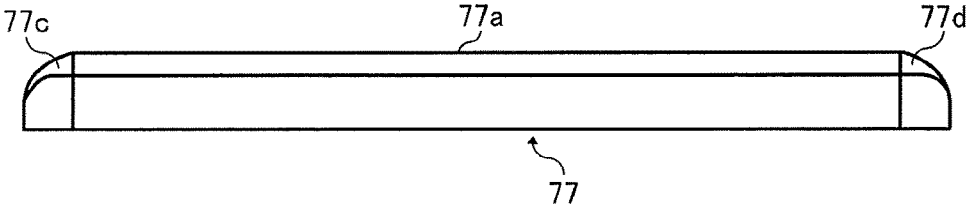
FIG. 15B is a side view of the supplementary thermal conductor of FIG. 15A.

FIG. 15A is a perspective view of a supplementary thermal conductor 77 as a fourth example of the supplementary thermal conductor 27 having flank faces. FIG. 15B is a side view of the supplementary thermal conductor 77. The supplementary thermal conductor 77 is an elongated, relatively thick cubic board having curved flank faces. Specifically, the supplementary thermal conductor 77 has arc, curved faces 77*c* and 77*d* at opposed end portions of a belt sliding-contact face 77*a* in a longitudinal direction of the supplementary thermal conductor 77. In addition, the supplementary thermal conductor 77 has edge surfaces on the entry side N1 and the exit side N2 of the fixing nip N curved not to affect separation of the sheet P from the fixing belt 21. Since the supplementary thermal conductor 77 has such curved corners and edges at the opposed end portions in the longitudinal direction thereof, the inner circumferential surface of the fixing belt 21 does not contact angular corners and edges that increases the load on the inner circumferential surface of the fixing belt 21. In addition, the curved corners and edges of the supplementary thermal conductor 77 prevent an excessive bending of the fixing belt 21. Thus, the supplementary thermal conductor 77 reduces attrition of the inner circumferential surface of the fixing belt 21.

Further to reduce attrition of the inner circumferential surface of the fixing belt 21, the belt sliding-contact face (e.g., belt sliding-contact face 77*a*) of the supplementary thermal conductor (e.g., supplementary thermal conductor 77) may be coated with resin to enhance smooth sliding of the inner circumferential surface of the fixing belt 21 over the belt sliding-contact face. For example, a belt sliding-contact face made of PTFE resin exhibits enhanced non-adherence, in other words, releasability, and repels water effectively, allowing the inner circumferential surface of the fixing belt 21 to slide over the belt sliding-contact face smoothly, thereby reducing attrition of the inner circumferential surface of the fixing belt 21. As another example, a belt sliding-contact face made of polyamide imide (PAI) resin exhibits enhanced heat resistance and wear resistance while facilitating smooth sliding of the inner circumferential surface of the fixing belt 21 over the belt sliding-contact face. Accordingly, such a belt sliding-contact face made of PAI reduces attrition of both the supplementary thermal conductor and the inner circumferential surface of the fixing belt 21. Furthermore, a lubricant may be interposed between the inner circumferential surface of the fixing belt 21 and the belt sliding-contact face of the supplementary thermal conductor to dramatically reduce attrition of both the supplementary thermal conductor and the inner circumferential surface of the fixing belt 21. For example, a grease with enhanced viscosity, that is, a decreased fluidity, may be used as a lubricant. Such a grease may remain between the supplementary thermal conductor and the inner circumferential surface of the fixing belt 21, thereby maintaining the lubricity therebetween for a relatively long period of time. Preferably, the grease may have a fluorine base oil that exhibits enhanced heat resistance.

As illustrated in FIGS. 4, 6 and 12, the supplementary thermal conductor 27 includes the convex portion 27*i* on the exit side N2 of the fixing nip N through the sheet conveyance span in the longitudinal direction of the supplementary thermal conductor 27, so as to facilitate separation of the sheet P from the fixing belt 21 when the sheet P is ejected from the fixing nip N. On the other hand, as illustrated in FIG. 6, the nip formation pad 24 has portions facing and conforming to the flank faces 27*d* and 27*e* of the supplementary thermal conductor 27. In addition, the nip formation pad 24 has a portion facing and conforming to the convex portion 27*i* of the supplementary thermal conductor 27.

In the embodiment described above, the supplementary thermal conductor (e.g., supplementary thermal conductor 27) is incorporated in the fixing device 20 that includes the nip formation pad 24 provided with the end heater 26.

Alternatively, the supplementary thermal conductor may be incorporated in a fixing device without an end heater.

Figure 16:
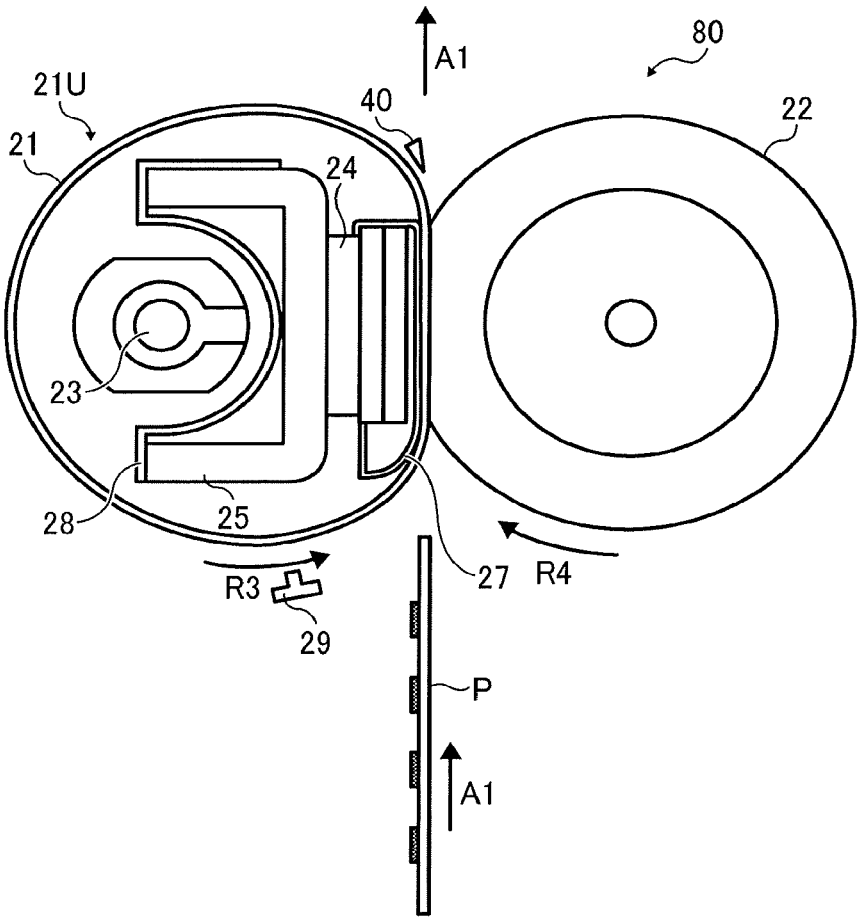
FIG. 16 is a cross-sectional view of a fixing device according to a second embodiment of the present disclosure.

FIG. 16 is a schematic cross-sectional view of a fixing device 80 according to a second embodiment of the present disclosure. The basic configuration of the fixing device 80 is identical to the configuration of the fixing device 20. However, unlike the fixing device 20, the fixing device 80 includes one heater 23 and no end heater. For example, in the fixing device 20, the nip formation pad 24 has the recess 24*a* that accommodates the end heater 26*a* as illustrated in FIG. 6. By contrast, in the fixing device 80, the nip formation pad 24 does not have the recess 24*a*. That is, the nip formation face 24*c* of the nip formation pad 24 is a uniformly flat face in the longitudinal direction of the nip formation pad 24.

According to the embodiments described above, a nip formation assembly (e.g., nip formation assembly 24U) includes a supplementary thermal conductor (e.g., supplementary thermal conductor 27). The supplementary thermal conductor has an edge portion dimensioned to distance the supplementary thermal conductor from an endless belt or fixing rotator (e.g., fixing belt 21) at an end portion of the supplementary thermal conductor in a longitudinal direction thereof parallel to an axial direction of the endless belt. A distance between the edge portion of the supplementary thermal conductor and the endless belt increases toward an end portion of the endless belt in the axial direction thereof. Thus, the end portion of the supplementary thermal conductor in the longitudinal direction thereof, more specifically, an end portion of a belt sliding-contact face over which the endless belt slides, of the supplementary thermal conductor in the longitudinal direction thereof, does not contact an inner circumferential surface of the endless belt, thereby preventing the endless belt from being scraped or having a kink. In short, damage to the endless belt can be prevented.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a flexible endless belt formed into a loop and having an inner circumferential surface;

a heater to heat the endless belt;

a nip formation assembly disposed inside the loop formed by the endless belt, the nip formation assembly including:

a pressure pad; and a supplementary thermal conductor to conduct heat from the heater in an axial direction of the endless belt, the supplementary thermal conductor having a belt sliding-contact face over which the inner circumferential surface of the endless belt slides; and a pressure rotator to press against the nip formation assembly via the endless belt to form a fixing nip between the endless belt and the pressure rotator, through which a recording medium bearing a toner image is conveyed, wherein the supplementary thermal conductor has an edge portion dimensioned to distance the supplementary thermal conductor from the endless belt at an end portion of the belt sliding-contact face in a longitudinal direction of the supplementary thermal conductor parallel to the axial direction of the endless belt, and wherein a distance between the edge portion of the supplementary thermal conductor and the endless belt increases toward an end portion of the endless belt in the axial direction of the endless belt.

2. The fixing device according to claim 1, wherein the supplementary thermal conductor has a fixing nip span subjected to pressure from the pressure rotator via the endless belt, and wherein the edge portion of the supplementary thermal conductor is not present in the fixing nip span of the supplementary thermal conductor.

3. The fixing device according to claim 1, wherein, on an upstream side of the fixing nip in a recording medium conveyance direction, the edge portion of the supplementary thermal conductor starts inside an end point of the fixing nip in a longitudinal direction of the fixing nip parallel to the axial direction of the endless belt, in the longitudinal direction of the supplementary thermal conductor.

4. The fixing device according to claim 1, wherein, on an upstream side of the fixing nip in a recording medium conveyance direction, the edge portion of the supplementary thermal conductor is outside an end point of the fixing nip in a longitudinal direction of the fixing nip parallel to the axial direction of the endless belt, in the longitudinal direction of the supplementary thermal conductor.

5. The fixing device according to claim 1, wherein, on a downstream side of the fixing nip in a recording medium conveyance direction, the edge portion of the supplementary thermal conductor is outside an end point of a recording medium conveyance span in the longitudinal direction of the supplementary thermal conductor, and wherein the recording medium conveyance span corresponds to a width of the recording medium having a maximum conveyable sheet size in the axial direction of the endless belt.

6. The fixing device according to claim 1, wherein the edge portion of the supplementary thermal conductor is flat.

7. The fixing device according to claim 1, wherein the edge portion of the supplementary thermal conductor is curved.

8. The fixing device according to claim 1, wherein the belt sliding-contact face of the supplementary thermal conductor is coated to reduce attrition of the inner circumferential surface of the endless belt.

9. The fixing device according to claim 1, wherein a lubricant is interposed between the belt sliding-contact face of the supplementary thermal conductor and the inner circumferential surface of the endless belt.

10. The fixing device according to claim 1, wherein the nip formation assembly further comprises an end heater disposed at an end portion of the pressure pad in a longitudinal direction of the pressure pad.

11. The fixing device according to claim 10, wherein the end heater is a contact, heat-transfer heater.

12. An image forming apparatus comprising:

an image forming device to form a toner image; and the fixing device according to claim 1, disposed downstream from the image forming device in a recording medium conveyance direction, to fix the toner image on a recording medium.

* * * * *